United States Patent [19]

Cardwell, Jr.

[11] Patent Number: 4,578,616

[45] Date of Patent: Mar. 25, 1986

[54] TUNGSTEN HALOGEN INCANDESCENT LAMP HAVING AN IMPROVED MOUNTING STRUCTURE

[75] Inventor: John G. Cardwell, Jr., Milan, Ohio

[73] Assignee: General Electric Company, Schenectady, N.Y.

[21] Appl. No.: 618,179

[22] Filed: Jun. 7, 1984

[51] Int. Cl.[4] ..... H01K 1/22; H01K 1/40

[52] U.S. Cl. ..... 313/579; 313/271; 313/285

[58] Field of Search ..... 313/579, 623, 271, 273, 313/277, 279, 578, 269, 275, 285

[56] References Cited

U.S. PATENT DOCUMENTS

| | | | |
|---|---|---|---|
| 3,441,772 | 4/1969 | Cardwell, Jr. | 313/579 X |
| 3,706,900 | 12/1972 | Van Beek | 313/579 |
| 4,145,630 | 3/1979 | DeCaro et al. | 313/273 |

*Primary Examiner*—David K. Moore

*Assistant Examiner*—K. Wieder

*Attorney, Agent, or Firm*—John P. McMahon; Philip L. Schlamp; Fred Jacob

[57] ABSTRACT

A single-ended tungsten halogen incandescent lamp having an improved mounting assembly for a planar multi-filament is disclosed. The improved mounting assembly comprises, in part, means rigidly located in the pinch seal end of the lamp for coupling the outer lead-in wires to support rod members of the mounting assembly. The means for coupling comprises a first foil member and a first tab member, and a second foil member and a second tab member. The foil members and tab members are arranged with the outer lead-in wires and support rods to form a torsion bar-like configuration which holds the planar multi-filament in the central region within the lamp itself. The torsion bar-like configuration also finds application to lamps other than this tungsten halogen incandescent lamp.

1 Claim, 4 Drawing Figures

Fig. 1
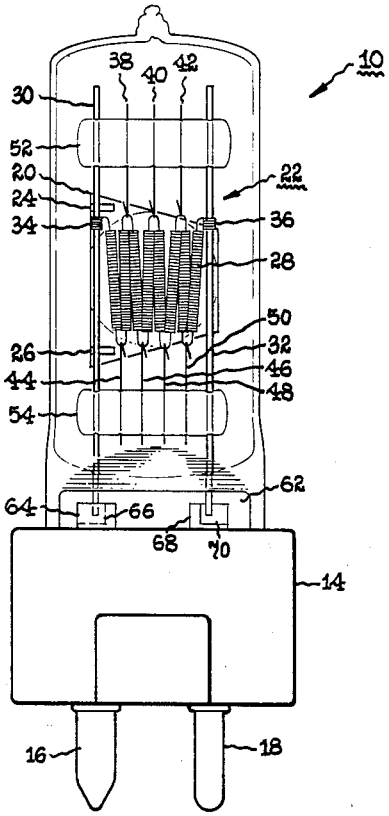
Fig. 2
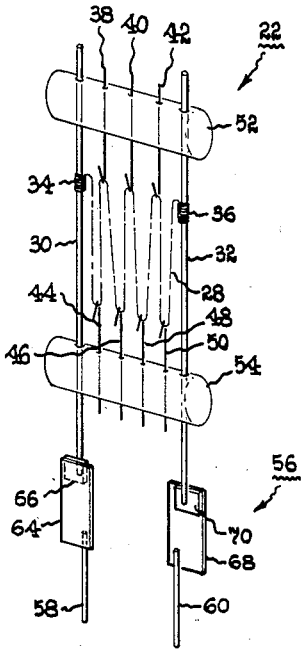
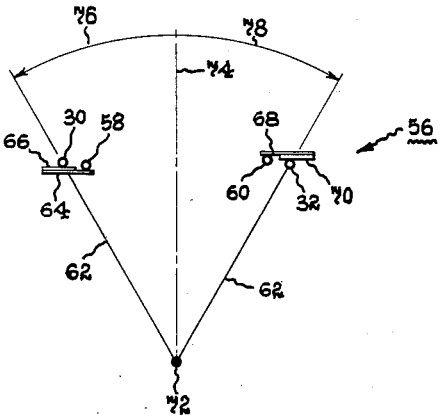
Fig. 3
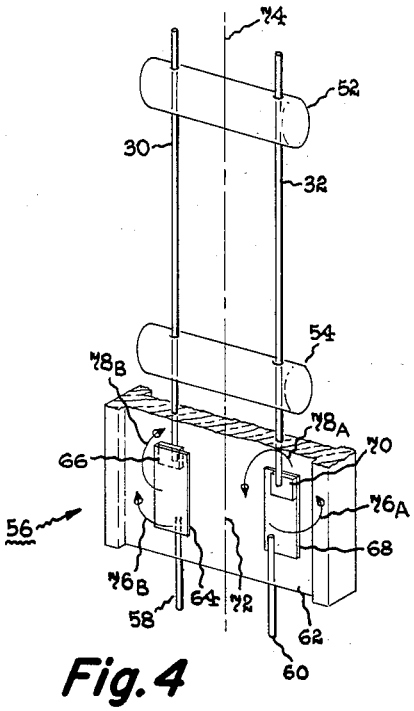
Fig. 4

TUNGSTEN HALOGEN INCANDESCENT LAMP HAVING AN IMPROVED MOUNTING STRUCTURE

BACKGROUND OF THE INVENTION

This invention relates to electric lamps, and more particularly, to high intensity tungsten halogen incandescent lamps having an improved mounting assembly and finding applications in studio lighting and projection lamps.

In such high intensity lamps a planar multi-filament is commonly lodged within the central region of the lamp by a relatively complex mounting assembly. In some cases, the planar multi-filament is connected to the mounting assembly by a plurality of coil support members lodged into and extending out of support bridge members of the mounting assembly. These mounting assemblies commonly have one such coil support member having a length exceeding those of the other members and which member extends into a exhaust channel of the tungsten halogen lamp formed during the exhaust process of the lamp.

Although the longer support member advantageously provides for confinement of the planar filament to the central region of the lamp, it presents certain problems during the manufacturing process of these lamps. One such problem occurs during the flushing process typically utilizing an inert gas to protect the mount structure against deleterious thermal and chemical reactions and wherein a flush tube is inserted into the exhaust channel of the lamp tube having within its confines the longer support member. During this flushing process it is typically necessary to insert the flush tube into and through the exhaust channel of the lamp so that the flush tube is placed into the bulb chamber to allow the inert gas to provide protection for the mount structure and foil seal member of the lamp. If this protection is not provided the lamp part will be damaged during the heating involved with the subsequent pinched sealing process of the lamp. The longer support member positioned in the confines of the exhaust chamber hinders the desired accomplishments of the flushing process. Further, during the subsequent filling process similar difficulties ensue. It is desired that a mounting assembly for a planar filament be provided for a high intensity incandescent lamp not having the limitations created by the longer coil support member of the mounting assembly.

Accordingly it is an object of the present invention to provide an improved mounting structure that centrally locates and maintains the planar multi-filament within the tungsten halogen lamp without the need of any excessive coil support member.

SUMMARY OF THE INVENTION

The present invention is directed to an improved mounting assembly for holding a planar multi-filament for a high intensity tungsten incandescent lamp at a predetermined central position within the envelope of the lamp.

The improved mounting assembly comprises a pair of substantially straight support rod members extending alongside opposite sides of the planar multi-filament and connected to coiled leg portions of the planar multi-filament. The mount further comprises a pair of insulating bridge cane-like members transversely located between opposite ends of the support rod members to provide a structure that surrounds the planar filament. The mount assembly further comprises coil support members anchored into the bridge cane members and engaging uncoiled wire segments of the planar filament. The mount assembly further comprises means, rigidly lodged within a pinch seal of the lamp itself, for coupling the outer lead-in wires of the lamp to the support members. The means for coupling comprises a first foil member and a first tab member, and a second foil member and a second tab member for respectively connecting one end of each of the outer leads, which are extending through the envelope, to one end of each of the support rod members. The one end of the outer leads being respectively connected to opposite surfaces of the foil members. The respective support members are connected to the same surface as the respective outer lead and at the opposite end of the foil members by affixing respective support rods to the tab member of the respective foil members.

The features of this invention believed to be novel are set forth with particularity in the appended claims. The invention itself, however, as regards to its structure may be more readily understood with reference to the following description taken in conjunction with the accompanying drawings.

BRIEF DESCRIPTION OF THE DRAWING

FIG. 1 illustrates a tungsten halogen incandescent lamp in accordance with the present invention.

FIG. 2 shows an improved mounting structure in accordance with the present invention.

FIGS. 3 and 4 are functional illustrations of a torsion bar-like configuration of the mounting structure of the present invention.

DETAILED DESCRIPTION OF THE PREFERRED EMBODIMENTS

FIG. 1 illustrates a tungsten halogen incandescent lamp 10 in accordance with the present invention. The lamp 10 comprises a light-transmissive outer envelope 12 formed of glass or a quartz material and which is sealed and attached to an electrically insulative base member 14 having at its end a pair of insertable metal pins 16 and 18. If desired, the lamp 10 may have a tungsten proximity reflector 20 connected to a mounting assembly 22 by support members 24 and 26 (partially shown) and positioned on one side of a planar multi-filament 28. The envelope 12 is evacuated and then filled with a suitable inert gas such as nitrogen at a pressure of about 1900 millimeters of Hg and dosed with a halogen additive and then sealed-off.

The planar multi-filament 28 is comprised of tungsten wire. The multi-filament 28 has a plurality of uniformly spaced coil sections that are joined by uncoiled sections of filament wire and coiled leg portions. The leg portions are wrapped around and joined to substantially straight support rod members 30 and 32 at locations 34 and 36 respectively. The support rods 30 and 32 extend along opposite sides of the planar multi-filament 28. The uncoiled portions of filament 28 are connected to the upper and lower portions of mount assembly 22 by coil support hooked members 38, 40 and 42, and 44, 46, 48, and 50, respectively.

The mount assembly further comprises a pair of insulating cylindrical bridge cane-like members 52 and 54, respectively, having the coil support members 38, 40 and 42 and 44, 46, 48 and 50 extending therethrough.

The bridge members 52 and 54 are transversely positioned between the support rods 30 and 32 to provide a structure that surrounds the planar filament 28.

The mounting assembly further comprises means for coupling 56 the outer lead-in wires 58 and 60 to the support rod members 30 and 32 and which is rigidly located in the pinched seal region 62 of the lamp 10. The coupling means 56 is of primary interest to the present invention and is shown in detail in FIG. 2.

The coupling means 56 comprises a first foil member 64 and a first tab member 66, and a second foil member 68, and a second tab member 70. The first and second foil members 64 and 68 have similar typical dimensions which are a length of about 7 mm, and a width of about 3 mm. Similarly, first and second tab members 66 and 70 have a length of about 1.5 mm, a width of about 1.5 mm, and a thickness of about 0.05 mm. The first and second foil members 64 and 68, and the first and second tab members 66 and 70 are formed of a material selected from the group consisting of molybdenum, tungsten and other metal materials which match the quartz thermal expansion characteristics.

The coupling means 56, by means of foil member 64 and tab member 66, connect one end of the outer lead-in wire 58, that is extending through the pinch seal 62 shown in FIG. 1, to one end of the support rod member 30. The other end of outer lead-in wire 58 is connected (not shown) to the metal pin 16 of the base 14. Coupling means 56 of FIG. 2, by means of foil member 68 and tab member 70 connects one end of the outer lead-in wire 60, that is extending through the pinch seal 62, to one end of the support rod member 32. The other end of outer lead-in wire 60 is connected (not shown) to the metal pin 18 of the base 14. The outer leads 58 and 60 along with the support rods 30 and 32 are respectively connected in alternating lead-foil relationships to opposite surfaces of foil members 64 and 68. The support rod members 30 and 32 are connected to their respective foil members 64 and 68 by respectively affixing, by means such as welding, rod members 30 and 32 to tab members 66 and 70.

In the operation of the coupling means 56 rigidly lodged in the pinch seal 62 and having the arrangement of the foil members 64 and 68, tab members 66 and 70, the outer lead-in wires 58 and 60, and support rods 30 and 32 operate to form a torsion bar-like configuration which maintains the mount assembly 22 having the connected planar multi-filament 28 within the central region of the envelope 12. In general, as mount assembly 22 attempts to rotate or tilt away from the central region of envelope 12 it is constrained by a torque-like action of an equal and opposite force urging the mount assembly back to its central location. The functional operation of the present invention is described with reference to FIGS. 3 and 4.

FIG. 3 shows the coupling means 56 as having an arrangement comprised of first and second foil members 64 and 68, first and second tab members 66 and 70, outer lead-in wires 58 and 60 and support rods 30 and 32 previously described with reference to FIG. 2. The foil members 64 and 68 are interconnected by a path provided by pinch seal 62. FIG. 3 further shows coupling means 56 as having a central position 72 located in pinch seal 62 and aligned with a central axis 74 of the lamp 10. The approximate location of the foil member 64 along with its members 30, 58 and 66 are shown in FIG. 3 as displaced in a counter-clockwise manner from the central axis 74 by a radial arc distance 76, whereas, the approximate location of the foil member 68 along with its members 32, 60 and 70 are shown in FIG. 3 as displaced in a clockwise manner from the central axis 74 by a radial arc distance 78.

The coupling means 56 provides an equilibrium position locating the transverse mid-portion of the mounting assembly 22 along the central axis 74. If the mounted assembly 22 is rotated or tilted away from the central axis, for example in a counter-clockwise direction 76, the coupling means 56 exerts a substantially equal and opposite torque-like force in a clockwise direction 78 so that the mid-portion of the mounting assembly is returned to a position along the central axis 74.

A further functional illustration of the torsion bar-like configuration of the present invention is shown in FIG. 4. FIG. 4 shows the mounting assembly 22, described with regard to FIG. 2 along with the pinch seal 62 of FIG. 1, and torsion-like arrangement described with regard to FIG. 3. FIG. 4 further shows rotational arrows $76_A$, $76_B$, $78_A$ and $78_B$.

Rotational arrow $76_A$ is meant to represent a horizontal-like planar, clockwise rotational force about which the second foil 68 and second tab 70 of the coupling means 56 may be subjected, which by the torsion bar-like operation of the present invention creates a substantially equal and opposite horizontal-like planar counter-clockwise torque-like force $76_B$ about the first foil 64 and tab 66 so that the mid-portion of the mounting assembly is returned to its equilibrium position about the central axis 74. In a manner similar to the description for rotational arrow $76_A$, rotational arrow $78_A$ is meant to represent a vertical-like planar, counter-clockwise, rotational force about the second foil 68 and second tab 70 which by the operation of the present invention is responded to by a vertical-like planar, torque-like clockwise force shown by arrow $78_B$. It should be understood that the descriptions of rotational arrows $76_A$ and $78_A$ are interchangeable with arrows $76_B$ and $78_B$.

It should now be appreciated that the present invention provides for a mounting assembly which holds the planar multi-filament 28 in a central location without the need of any extending coil support member discussed in the "Background". It should be further appreciated that the present invention by not having any extending coil member does not hinder the manufacturing process in a manner as discussed in the "Background." Still further, the present invention eliminates these discussed manufacturing restrictions while still providing a relatively simple and uncomplicated mounting assembly 22.

Still further, it should be appreciated that although the hereinbefore-given description was for a high intensity tungsten incandescent lamp, the present invention contemplates that the torsion bar-like configuration is equally applicable to other type lamps having coiled-coil filaments that desire mounting stability for their light source.

What I claim as new and desire to secure by Letters Patent of the United States is:

1. A tungsten-halogen incandescent lamp comprising a tungsten wire planar multi-filament having coiled-like sections joined together by uncoiled sections and further having coiled leg sections, said lamp further comprising a light-transmitting envelope of vitreous material having a pinch seal end and a pair of rigid outer lead-in wires each having one end extending into said envelope, said envelope containing an inert gas along with a halogen additive for providing a halogen atmosphere in the lamp during the operation thereof, said lamp further comprising;

(a) a mounting assembly holding the planar multi-filament in a predetermined central position within the envelope and comprising;

($a_i$) A pair of substantially straight support rods extending alongside opposite sides of the planar filament and connected to said coiled leg portions;

($a_{ii}$) a pair of insulating bridge cane-like members transversely located between opposite ends of said support members and providing a structure that surrounds the planar filament;

($a_{iii}$) coil support members anchored in said bridge cane-like members and engaging said uncoiled segments of said planar filament;

($a_{iv}$) means rigidly lodged in said pinch seal end for coupling said rigid outer lead-in wires to said support rod members comprising:

a first foil member and a first tab member, and a second foil member and a second tab member for respectively connecting said one end of each outer lead-in wires extending through said envelope to one end of each support rod members, and said one end of said outer lead-in-wires being respectively connected to opposite surfaces at one end of said foil members, said respective support members being connected to the same surface of said foil members as their respective outer lead-in wires and at the opposite end of the said foil members by affixing respective support rods to the tab member of the respective foil members.

* * * * *